US006135831A

United States Patent [19]

Lanni et al.

[11] Patent Number: 6,135,831

[45] Date of Patent: Oct. 24, 2000

[54] IMPELLER FOR MARINE WATERJET PROPULSION APPARATUS

[75] Inventors: Francesco Lanni, Walpole; Neal A. Brown, Lexington, both of Mass.

[73] Assignee: Bird-Johnson Company, Walpole, Mass.

[21] Appl. No.: 09/425,824

[22] Filed: Oct. 22, 1999

[51] Int. Cl.[7] ..... B63H 1/14

[52] U.S. Cl. ..... 440/49; 440/67; 440/79; 416/238

[58] Field of Search ..... 440/49, 66, 67, 440/79; 416/179, 223, 228, 238, 242

[56] References Cited

U.S. PATENT DOCUMENTS 3,972,646 8/1976 Brown et al. ..... 416/223 R
5,226,804 7/1993 Do ..... 416/228

FOREIGN PATENT DOCUMENTS 276595 3/1990 Austria ..... 440/67

*Primary Examiner*—Jesus D. Sotelo
*Attorney, Agent, or Firm*—Baker Botts L.L.P.

[57] ABSTRACT

An impeller for a marine waterjet propulsion system has blades that are configured to reduce cavitation, vibration, noise and physical damage to the major components of the propulsion system or host vessel of installation. The leading edge of each blade of the impeller is skewed forwardly over at least the outer 70% of its span, the forward skew being maximum at the tip and being not less than 35°. The impeller has a blade area ratio of not less than 1.5. The chord lengths of each blade increase progressively from the point of minimum skew to the tip, resulting in reduced loading in the cavitation critical region. A partial or full tip band may be affixed to the blade tips.

14 Claims, 4 Drawing Sheets

IMPELLER FOR MARINE WATERJET PROPULSION APPARATUS

BACKGROUND OF THE INVENTION

Universally, marine waterjet propulsion systems consist of rotating and stationary rows of blades. The rotating blade rows are termed impellers. The purpose of the rotating blade rows is to raise the total energy of the water passing through the propulsion system, which can be used to produce useful thrust to propel the host vessel through the water. The stationary blade rows are termed diffusers or guide vanes. One purpose of the stationary blade rows, if positioned downstream from a rotating blade row, is to recover rotational flow energy produced by the impeller that can be used to augment the ability of the propulsion system in producing useful thrust to propel the host vessel through the water. If the stationary blade row is positioned upstream from a rotating blade row, one of its purposes is to mitigate large-scale fluctuations in flow velocity magnitude and direction seen by a rotating blade row.

Fluctuations in the magnitude and direction of flow velocities can result in detrimental consequences to the performance of the propulsion system. Specifically, they can cause fluctuating pressures to occur on any effected blade row, rotating or stationary. These fluctuations typically result in reduced efficiency for the propulsion system, increased vibration, and increased noise. In the event of severe fluctuations, the resulting surface pressures on blade rows may be reduced to levels below the vapor pressure of water, causing the water to boil. That phenomenon is termed cavitation. Bubbles of water vapor are created on the surfaces of the blades, which may coalesce into large cavities that remain attached to the blades or which may be shed from the blade row surfaces to travel downstream. The cavities and bubbles are detrimental to the performance of the propulsion system in a number of ways.

If the extent of cavitation in the propulsion system is severe enough, blockage of the flow of water through the system occurs, resulting in cavitation breakdown, or thrust breakdown, where the useful thrust of the system is reduced catastrophically.

If the cavities or bubbles of water vapor find their way to a region of the system where pressures in the flow field are above the vapor pressure of water, rapid condensation of the water vapor occurs as the bubble implodes back into a liquid state. The action of that implosion is violent, resulting in excessive transient pressure fluctuations that are forceful enough to physically damage the structure of the propulsion system components.

Implosion of the water vapor bubbles will, at a minimum, result in volume and pressure fluctuations sufficient to generate noise. Additionally, these fluctuations result in vibration of the propulsion system structure as well as of the associated host vessel structure. The vibration can lead to fatigue failure of the structures, as well as their radiation of additional noise both within the host vessel and into the water.

Previously known waterjet propulsion systems suffer universally from cavitation. Typical installations of waterjet propulsion systems are such that fluctuations in the magnitude and direction of flow velocities cannot be sufficiently mitigated by any practical means without severely restricting the operating range of the host vessel. Over some range of vessel operating conditions, cavitation is severe enough to result in physical damage to the propulsion system or, at a minimum, in a significant increase in vibration and noise.

SUMMARY OF THE INVENTION

An object of the present invention is to provide a waterjet propulsion system which has two blade rows, one rotating and one stationary, that for any given size exhibits greater resistance to the onset of cavitation resulting from spatial and temporal fluctuations in the magnitudes and direction of flow velocity than previously known waterjet propulsion systems. Another object, which is of particular interest for oceanographic research, recreational, and military vessels, is to extend the operating range of the vessel over which cavitation induced noise and vibration are not present.

The foregoing objects are attained, in accordance with the present invention, by an impeller for a waterjet propulsion apparatus having an impeller with a plurality of blades, each of which is significantly skewed or swept forwardly, that is, in a direction opposite that of the impinging upstream water flow, measured relative to a coordinate system fixed to and revolving with the blade. In this way the blade tip leads the more inward portions of the leading edge in the direction of rotation. The forwardly skewed region extends inwardly from the outer tip along not less than 70% of the leading edge span of the blade. The projected skew angle measured between a line through the center of rotation and the leading edge point of minimum skew and a line through the leading edge point of minimum skew and the leading edge point of maximum skew (at the blade tip) is greater than 35°, and preferably greater than 50°.

The leading edge of the blade near the tip is typically the location of earliest cavitation onset due to fluctuations in upstream flow velocity related incidence. The effect of maximum forward skew at the tip acts to introduce three-dimensional flow affects that result in reductions of peak blade surface pressure fluctuations, which cause cavitation to occur. The reductions in fluctuations of peak blade surface pressures also reduce the blade loading fluctuations and resultant vibrations, this reducing a cause of structural damage to components of the propulsion system due to fatigue.

It is advantageous to introduce forward skew to the blade at the leading edge without correspondingly altering the shape of the trailing edge. In that way, the chord lengths of the blade are made to increase in at least the outer 70% of the blade span, resulting in an increase in projected blade area ratio. For a specified blade load an increase in blade area results in a reduction of the magnitude of the induced pressure on one side of the blade. The danger of cavitation with addition of fluctuations is thereby reduced. In particular, the projected blade area ratio is in excess of 1.5, the projected blade area ratio being defined as the number of blades multiplied by the blade area projected onto a plane perpendicular to the axis of rotation divided by the area of the projected outline of all the blades onto a plane perpendicular to the axis of rotation. The relatively large projected blade area ratio results in overall lower blade surface pressure magnitudes in the absence of flow velocity magnitude and direction fluctuations. In the presence of these fluctuations the tendency of peak blade surface pressure fluctuations to reach vapor pressure, and thus cause cavitation, is commensurately reduced.

The cavitation-inducing reduction of pressure near the leading edge of a blade which results from flow velocity incidence fluctuations is found to be mitigated by increased nose radius of the blade sections and by forward skew or sweep of the leading edge toward the blade tip. The benefit of blade section nose radius, however, is limited by the increased pressure reduction in the mean flow at the "shoulders" of the section noses. Further, given a blade section geometric parent form, increased nose radius implies increased blade section thickness which can yield unacceptable blockage and cavitation in the mean flow between the blades.

By reducing the pressure response to velocity fluctuation changes of incidence, the outwardly forward skewed blade leading edge more than compensates for the less than desired nose radii available to the designer. For a given incidence fluctuation, ambient pressure and velocity, the compensating leading edge skew angle is found to be inversely proportional to the square root of the section nose radius.

Another embodiment of the current invention includes a circumferential tip band structure surrounding and fixed to the tips of the impeller blades, which serves to prevent cavitation in a tip gap clearance and lends improved structural integrity to the bladed impeller assembly. The tip band may be partial or full—i.e., it may extend along only part of or along the entirety of the axial extents of the blades.

DESCRIPTION OF THE DRAWINGS

For a more complete understanding of the present invention, and the advantages thereof, reference may be made to the following written description of exemplary embodiments, taken in conjunction with the accompanying drawings.

DESCRIPTION OF THE EMBODIMENT

Figure 1:
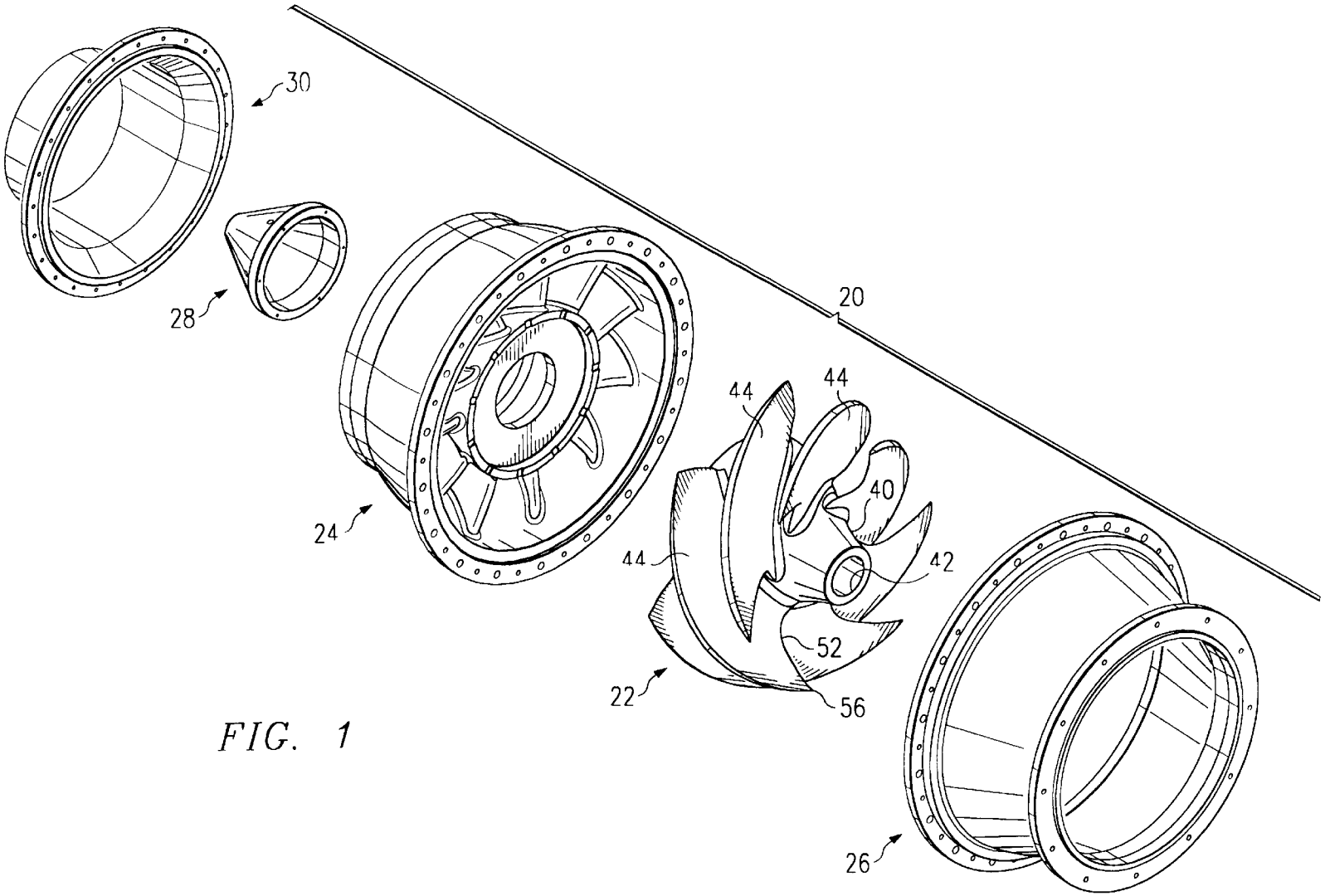
FIG. 1 is a schematic exploded pictorial view of a marine waterjet propulsion system assembly, which includes an embodiment of an impeller with forward skew applied to the leading edge of each blade according to the present invention.
Figure 2:
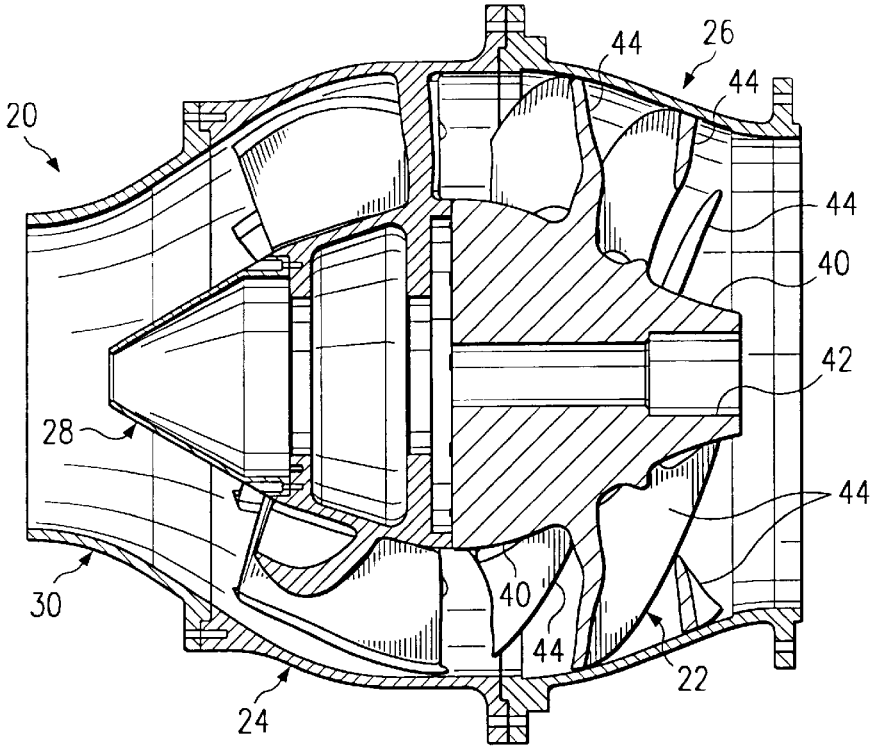
FIG. 2 is a side cross-sectional view of the marine waterjet propulsion system assembly of FIG. 1, showing it assembled and the view being taken along the lines 2—2 of FIG. 3.
Figure 3:
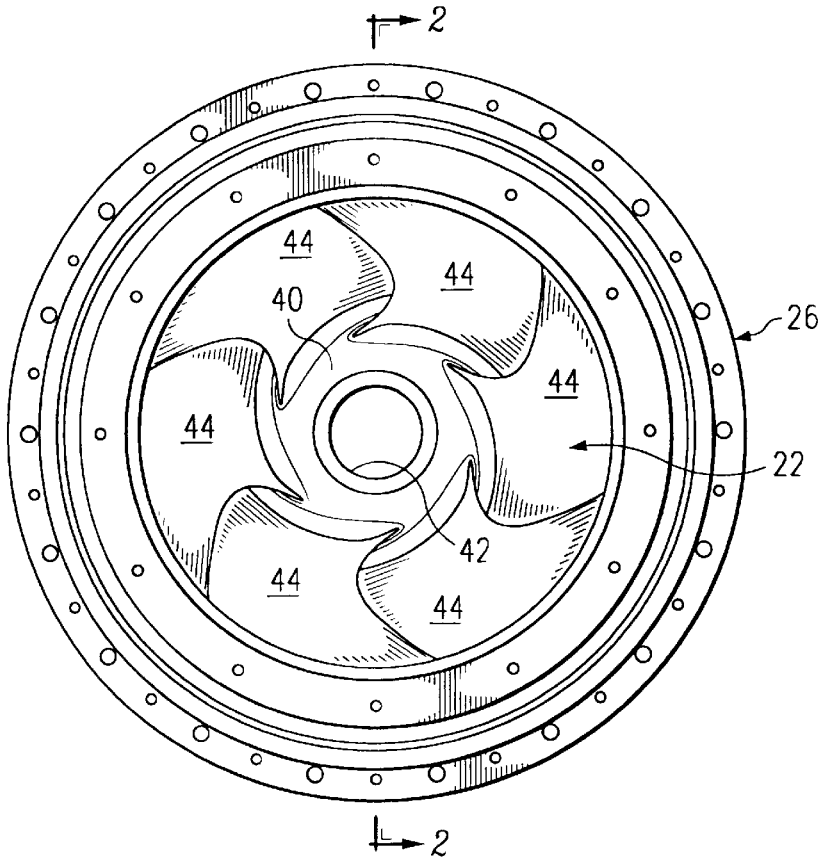
FIG. 3 is a front elevational view of the assembly of FIGS. 1 and 2.
Figure 4:
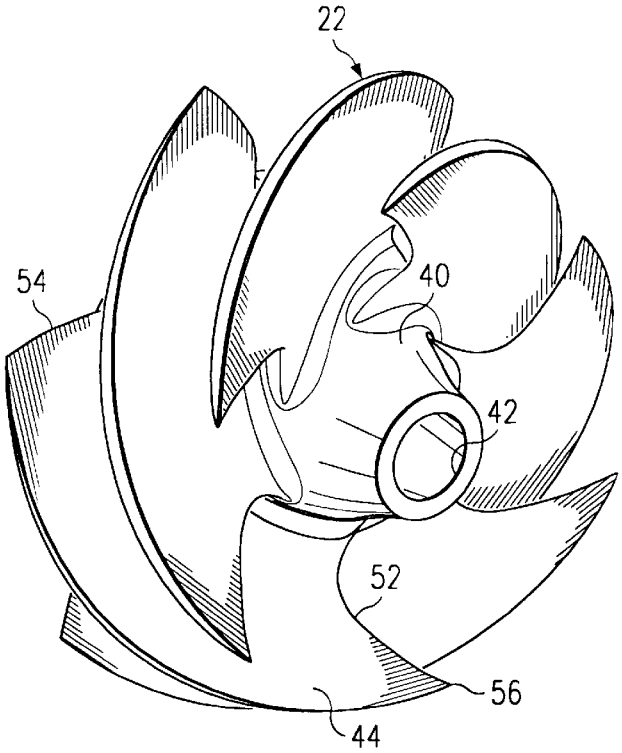
FIG. 4 is a pictorial view of the impeller of the assembly of FIGS. 1 to 3.
Figure 6:
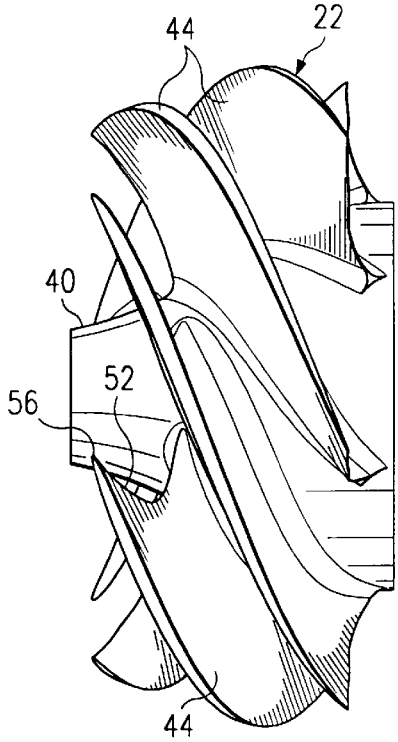
FIG. 6 is a side elevational view of the impeller of FIGS. 4 and 5.
Figure 5:
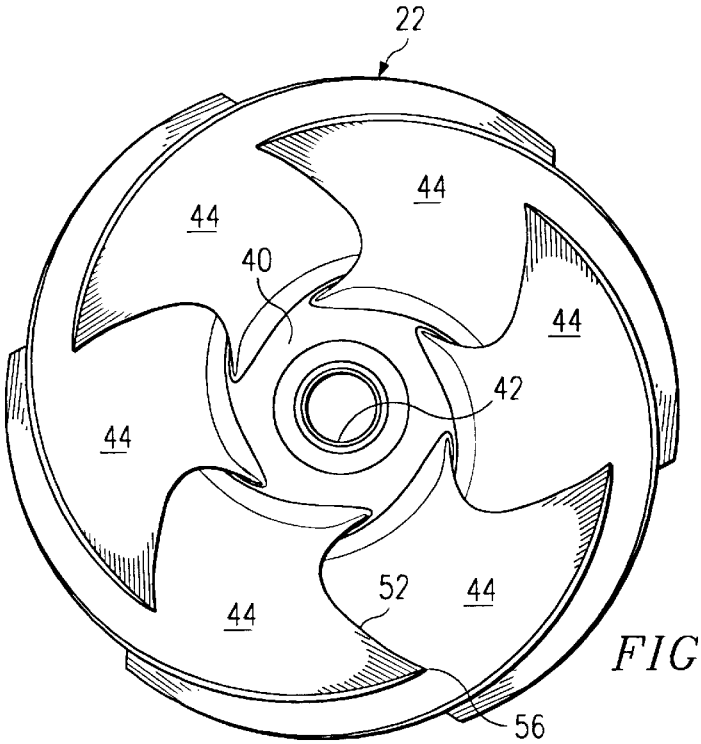
FIG. 5 is a front elevational view of the impeller of FIG. 4.

A marine waterjet propulsion system 20 utilizing one stationary blade row and one rotating blade row is shown generally schematically in FIGS. 1 to 3. The rotating blade row or impeller 22 is used in conjunction with the stationary blade row or diffuser 24 to impart energy to the flow of water through the propulsion system, which can be used to generate useful thrust. The remaining components of the marine waterjet propulsion system depicted, which include an impeller housing 26, a diffuser hub cone 28, and an exit nozzle 30, are used to contain and direct the flow of water through the propulsion system.

Water flow enters the impeller housing 26 and is acted upon by the impeller 22. The impeller 22 increases the energy of the water flow through the propulsion system, which can be used to generate useful thrust. In addition, the impeller 22 imparts rotational energy to the water flow, which cannot be used to generate useful thrust. The flow continues through the propulsion system to the diffuser 24 where the rotational energy imparted by the impeller 22 can be transformed into energy which can in turn be used to generate useful thrust. The cone 28 and the exit nozzle 30 in concert transform the energy imparted to the water flow through the propulsion system by action of the impeller and diffuser into useful thrust.

The impeller 22 has a hub 40, which is shaped somewhat like one-half of a football and has a axial hole 42 that receives a drive shaft (not shown), to which the impeller is affixed. Six identical, equally circumferentially spaced-apart impeller blades 44 extend in a row around the hub 40. The blade tips are in close running clearance with the inner surface of the impeller housing 26. Forward skew is applied to the leading edge of each of the six blades 44 of the impeller 22, as described below.

Although the embodiment of the impeller 22 shown in the drawings and described herein is a mixed flow type of impeller, the present invention may be applied to many different designs of impellers, including inducer types, axial types, and centrifugal types, and to impellers with various numbers of blades.

Figure 7:
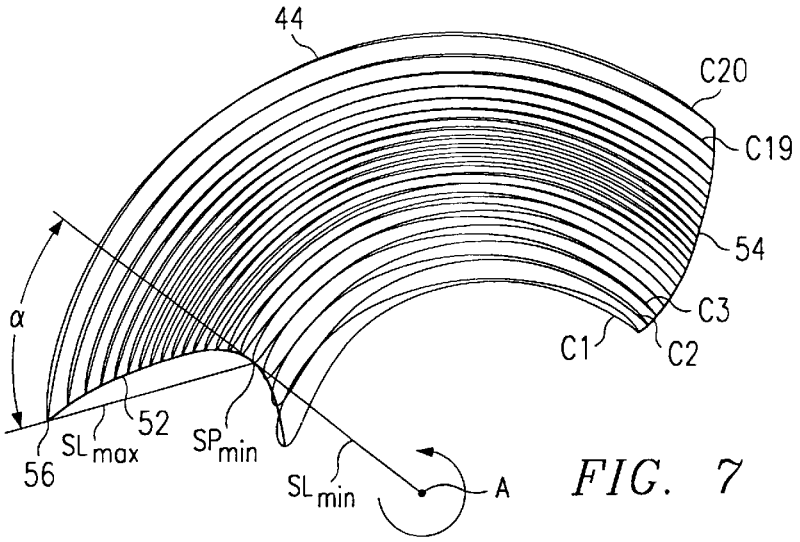
FIG. 7 is a diagram of one of the blades of the impeller of FIGS. 4 to 6, in which the blade sections are projected onto a plane perpendicular to the axis of rotation of the impeller.

FIG. 7 shows a single impeller blade 44 diagrammatically. The twenty double line curves C1, C2, etc. are projections onto a plane perpendicular to the axis A of the impeller 22 of blade sections formed by intersections of the blade by twenty equally spaced apart imaginary doubly curved cutting surfaces, each of which is generated by revolving a flow line of the flow path of water through the passage between the outer surface of the hub 40 and the inner surface of the impeller housing 26 about the axis A. The root blade section C1 and the tip blade section C20 depict the extent of the blade in the span wise direction, while the leading edge periphery 52 and the trailing edge periphery 54 depict the extent of the blade in the chord wise direction. The minimum projected skew line $SL_{min}$ is drawn through the axis of rotation A of the impeller and the point of minimum projected skew $SP_{min}$. The maximum projected skew line $SL_{max}$ is drawn through the point of minimum projected skew $SP_{min}$ and the tip leading edge point 56. The projected skew angle $\alpha$ between the maximum projected skew line $SL_{max}$ and the minimum projected skew line $SL_{min}$ is greater than 35° and, preferably, greater than 50°. Forward skew is maintained along the portion of the leading edge of the blade between the tip leading edge point 56 and the point of minimum projected skew $SP_{min}$, the amount of skew diminishing progressively from the point 56 along that portion. The point of minimum projected skew $SP_{min}$ is located at a distance from the tip that is not less than 70% of the projected span of the blade.

Figure 8:
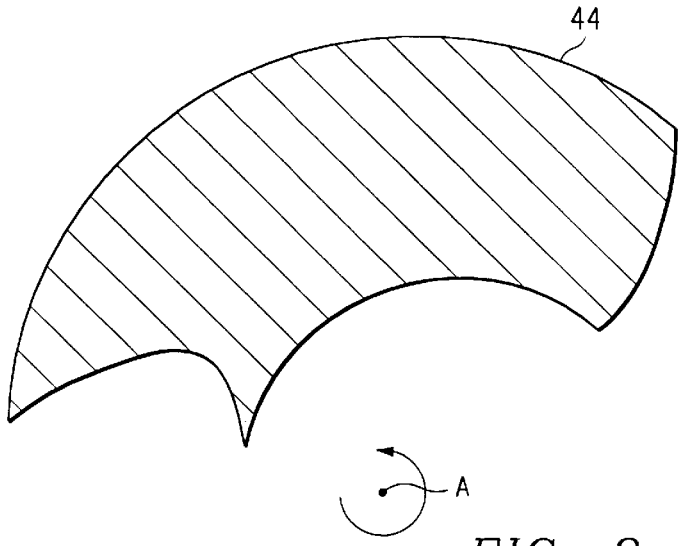
FIG. 8 is a diagram showing the peripheral contour of a single blade projected onto a plane perpendicular to the axis of rotation of the impeller.
Figure 9:
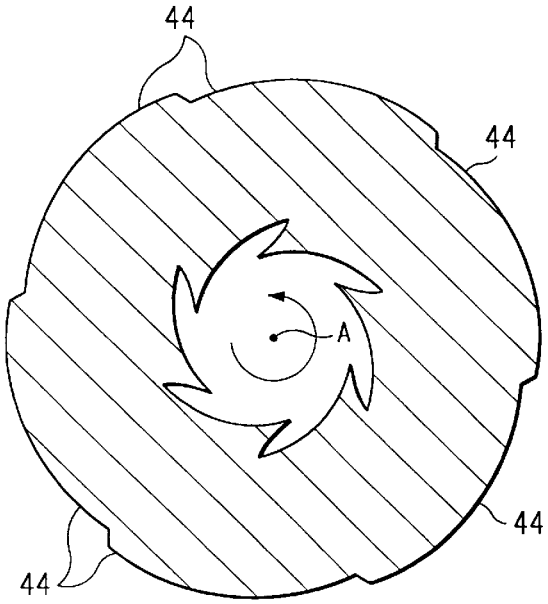
FIG. 9 is diagram showing the combined contours of the roots and tips of all of the blades projected onto a plane perpendicular to the axis of rotation of the impeller.

FIG. 8 depicts a true orthogonal projection of the area enclosed by the periphery of a single impeller blade 44 onto a plane perpendicular to the axis of rotation A. FIG. 9 depicts a true orthogonal projection of the area enclosed by the combined periphery of all six blades 44 of the impeller 26 onto a plane perpendicular to the axis of rotation A. The projected blade area ratio, which is calculated by multiplying the number of blades of the impeller by the projected area of a single blade (FIG. 8) and dividing by the area enclosed by the combined periphery of all six blades (FIG. 9), is greater than 1.5.

What is claimed is:

1. An impeller for marine waterjet propulsion apparatus comprising a plurality of blades, each blade having a leading edge with a forwardly skewed region extending inwardly from the outer tip along not less than 70% of the span of the leading edge of the blade.

2. The impeller as claimed in claim 1 and in which the skew of the forwardly skewed region of each blade is greatest at the outer tip, which has a skew of not less than 35°.

3. The impeller as claimed in claim 1 and in which the skew of the forwardly skewed region of each blade is greatest at the outer tip, which has a skew of not less than 50°.

4. The impeller as claimed in claim 1 and in which the chord lengths of each blade increase progressively in a direction from the root to the tip in a portion of the span corresponding to the forwardly skewed region, the blade sections being extended to accommodate leading edge skew.

5. The impeller as claimed in claim 1 and in which the projected blade area ratio is not less than 1.5.

6. The impeller as claimed in claim 1 and in which the maximum thickness of the blade section and the radius of the leading edge both increase progressively in a direction from the root to the tip in a portion of the span corresponding to the forwardly skewed region.

7. An impeller for marine waterjet propulsion apparatus comprising a plurality of blades, each blade having a leading edge with a forwardly skewed region extending inwardly from the tip along not less than 70% of the span of the leading edge of the blade, the skew of the forwardly skewed region of each blade being greatest at the outer tip, which has a skew of not less that 35°, and the chord lengths of each blade increasing progressively along not less than the outer 70% of the span in a direction from the root to the tip.

8. The impeller as claimed in claim 7 and in which the skew at the outer tip is not less than 50°.

9. The impeller as claimed in claim 7 and in which the projected blade area ratio is not less than 1.5.

10. The impeller as claimed in claim 7 and in which the maximum thicknesses of the blade sections of each blade and the radii of the leading edge of each blade both increase progressively along not less than the outer 70% of the span in a direction from the root to the tip.

11. An impeller for marine waterjet propulsion apparatus comprising a plurality of blades, each blade having a leading edge with a forwardly skewed region extending from the outer tip towards the inner root along not less than 70% of the span of the leading edge of the blade, the skew of the forwardly skewed region of each blade being greatest at the outer tip, which has a skew of not less that 35°, and the projected blade area ratio of the impeller is not less than 1.5.

12. The impeller as claimed in claim 1 and further comprising a circumferential tip band affixed to at least portions of the tips of the blades.

13. The impeller as claimed in claim 12 wherein the tip band extends along only part of the axial extents of the blades.

14. The impeller as claimed in claim 12 wherein the tip band extends along the entirety of the axial extents of the blades.

* * * * *